United States Patent [19]

O'Brien

[11] 4,289,259

[45] Sep. 15, 1981

[54] AUTOMATIC LADLER

[76] Inventor: John W. O'Brien, 607 S. Kelly St., Harrison, Ark. 72601

[21] Appl. No.: 97,433

[22] Filed: Nov. 23, 1979

[51] Int. Cl.[3] ..... B22D 41/04; B22D 41/06

[52] U.S. Cl. ..... 222/590; 222/629; 222/604; 222/70; 164/336

[58] Field of Search ..... 222/590, 629, 604, 356, 222/357, 358, 70; 164/318, 335, 336; 414/734, 917

[56] References Cited

U.S. PATENT DOCUMENTS

| | | | |
|---|---|---|---|
| 3,923,201 | 12/1975 | Hersh et al. | 222/604 |
| 4,074,837 | 2/1978 | Engel | 164/336 X |

FOREIGN PATENT DOCUMENTS

| | | | |
|---|---|---|---|
| 84917 | 5/1976 | Australia | 164/336 |
| 2104027 | 9/1971 | Fed. Rep. of Germany | 222/604 |
| 50-36417 | 11/1975 | Japan | 164/336 |

*Primary Examiner*—David A. Scherbel
*Attorney, Agent, or Firm*—Lowe, Kokjer, Kircher, Wharton & Bowman

[57] ABSTRACT

Automatic ladle systems adapted for use in metal die casting operations are disclosed herein. In a preferred form the invention comprises a rigid, supporting base on which a control platform is rotatably mounted for radially moving a ladle between a metal filling and metal pouring positions. The ladle is coupled to the platform by support arm structure extending from the platform which may be raised or lowered with a hydraulic cylinder. A parallelogram linkage system couples the ladle to the end of the support arm structure. Reach extension apparatus extending between the linkage and the platform moves the ladle outwardly with respect to the base during movement to a filling position. The reach extension apparatus and the parallelogram linkage allow the horizontal position of the ladle pour spout to remain substantially constant during raising and lowering of the ladle to prevent spillage. A tilting system interconnected with the linkage facilitates ladle draining. In one form of the invention the hydraulic cylinder employed for raising and lowering the support arms is provided with internal cushioning. Electrical and hydraulic control systems are provided for operation of the device.

23 Claims, 10 Drawing Figures

AUTOMATIC LADLER

BACKGROUND OF THE INVENTION

The present invention relates to ladle systems for pouring molten metal. More particularly, the present invention discloses automatic ladle systems for supplying metered amounts of metal for use with die casting machines.

Die casting machines typically employ a plunger system operating within a hollow shot sleeve in the machine for forcing molten metal under high pressure into a die. After the metal cools properly a casting will be formed. For proper operation the hollow shot sleeve must be filled with a metered amount of molten metal. Excess metal which is not required to fill the casting is confined in the shot sleeve in front of the plunger and subsequently solidifies to form a short cylinder known as a "biscuit". For proper operation the shot sleeve and other die components must be subjected to the high temperature metal for minimal periods of time during each casting cycle to prevent unnecessary component deterioration.

Although molten metal may be supplied to the die casting machine manually, it is known in the art to provide automatic ladle apparatus. However, known prior art machines suffer from several disadvantages. During die casting it is necessary to pour molten metal into the shot sleeve of the die casting machine through a small pour hole provided for this purpose. Machines which are inaccurate tend to splash or waste metal. Alternatively the use of a funnel or trough for directing the molten metal may be required. Molten metal is often wasted when sudden ladle movements cause spilling or sloshing.

Conventional die casting machines require pouring in confined areas, the ladle support and pivot mechanisms in an automatic ladle system must have very little overhang. Also die casting machines usually have some form of projecting rib on each side of the center of the front platen where pouring takes place. In order to clear the structure the ladle must retract a considerable distance when moving to the pouring position. Thus it would seem beneficial to provide an automatic ladler machine with some form of means whereby the ladle may move inwardly and outwardly with respect to the apparatus as it is radially moved between filling and pouring positions.

Prior art automatic ladle systems typically misfunction in response to moderate variation in metal bath level during the filling operation. This results in an increase in labor costs since the metal holding furnace must be refilled constantly with such troublesome machines. During operation ladles require the application of a protective coating once or twice a shift in order to prevent attack or deterioration caused by the molten metal being transferred. Prior art designs usually require large amounts of down time in order to change ladles to apply a protective coating. In the prior art ladle immersion control systems have employed level detectors usually including probes which lower into molten metal. As the probes are immersed in the molten metal an electrical circuit is completed triggering a down travel stop mechanism. With construction of this type molten metal often builds up on the probe and high temperatures can destroy insulation, break wires, and otherwise injure the apparatus.

SUMMARY OF THE INVENTION

The present invention comprises an automatic ladle system, for use in die casting operations.

In a preferred form of this invention the automatic ladler comprises a rigid supporting base structure which may be attached to a stationary structure or supporting surface. A control platform is rotatably suspended above the base by a vertically oriented stanchion system. The ladle bucket is operatively coupled to the platform for radial movement between metal filling and metal pouring positions.

Preferably a pair of elongated, parallel support arms are pivotally coupled to the platform and extend outwardly to the ladle, being coupled thereto through a plurality of pivoted linkage members. Hydraulic cylinder means are preferably employed to move the support arms up and down, thereby effectuating vertical movement of the ladle. Preferably, reach extension means are provided for extending the ladle bucket outwardly and away from the base in response to platform rotation. The reach extension apparatus preferably comprises a reach rod extending between the platform and the bucket support linkage. As the platform is revolving toward a filling position cam means draw the reach rod toward the platform, thereby projecting the ladle bucket outwardly.

A tilting system interconnected with the ladle support linkage may be selectively actuated to tilt the bucket to pour molten metal into the die casting machine shot sleeve. The tilting system preferably comprises a rotatable tilt bar which is transversely coupled between the ladle support arms and journaled for rotation therethrough. The ladle bucket linkage is pivotally coupled to the pivot bracket driven by the tilt bar. An elongated tilt arm coupled to the platform may be moved axially to rotate the tilt bar for tilting of the bucket. Importantly, the combination of parallelogram linkage disclosed wherein one arm of the linkage is shorter than the other, thereby imparting a slight forward tilt to the ladle as the reach extension system retracts the ladle. Also during the upward movement of the ladle, different length tilt levers impart a slight forward tilt. In this fashion sloshing or spilling of molten metal from the filling slot during raising and rotation will be avoided.

The ladle support arms are preferably raised and lowered by a hydraulic piston system. In an alternative embodiment of this invention the hydraulic piston may be provided with means for cushioning the ladle to prevent sloshing or spilling. The cushioning system comprises a unique projection defined about the internal cylinder piston which partially occlude inlet and outlet ports during the end portion of the piston cylinder travel. The ring shaped extension means project from the internal cylinder and matingly engage receptive structure at the limit to piston travel. When the support arms are to be lowered, the initial start will be extremely slow due to cushioning effect. Once the inlet ports are unblocked by movement of the piston projection beyond the hydraulic orifices, the hydraulic cylinder will be displaced at its normal rate.

The design of the linkage system enables the ladle bucket pour spout to maintain a relatively constant horizontal position during vertical movement. The linkage preferably comprises a pair of elongated members arranged in the form of a parallelogram. These members extend and are rotatably coupled between first and second pivot bracket means. The first pivot bracket is rotatably coupled to a tilt bar which extends transversely between the support arms, and the second pivot bracket is rigidly secured to the ladle. The first parallelogram linkage is pivotally coupled to the first pivot bracket at an intermediate location and includes an extension portion which projects upwardly therefrom. The reach control system includes an elongated reach arm extending between the linkage extension portion and the platform. When the reach arm is axially moved the first parallelogram linkage member pivots against the first bracket, causing the bracket to be moved outwardly with respect to the platform. Similar elongated tilt rod means are provided for rotating the tilt bar in response to axial tilt rod movement. Hydraulic means preferably include within the stanchion housing are provided to operate the tilt rod so as to rotate the tilt bar causing tilting of the ladle bucket. The overall effect of the linkage, reach means and tilt systems is to substantially maintain the pour point of the ladle bucket constant so as to prevent spillage of molten metal.

Thus a broad object of this invention is to provide a reliable and efficient automatic ladler machine.

Another object of this invention is to provide an automatic ladler device which will pour molten metal accurately thereby preventing the splashing and wasting thereof.

A similar object of this invention is to provide an automatic ladle system adapted to pour molten metal in confined areas.

Yet another object of this invention is to provide a ladle device which will move very smoothly without sudden changes in motion or direction in order to prevent the spillage of molten metal.

A similar object of this invention is to provide an automatic ladler system with a ladle support or suspension system which may function properly notwithstanding considerable variations in metal batch level.

Yet another object of this invention is to provide a ladle design in which the ladle may be quickly and easily replaced to minimize down time during routine maintenance.

Another important object of this invention is to provide linkage for an automatic ladling machine which allows the pour point of the ladle to remain substantially stationary during tilting thereof.

Still another object of this invention is to provide a system for reliably controlling the immersion depth of a ladle bucket during filling.

A similar object of this invention is to provide a reach increase system whereby the ladle bucket will be moved outwardly and away from the apparatus in response to rotation.

A still further object of this invention is to provide an automatic ladler of the character described which will avoid transfer of dross or other contaminants usually found floating on top of the molten metal bath to the die cast machine.

Yet another important object of this invention is to provide an automatic ladle in which dripping from the fill slot of the ladle bucket is discouraged.

These and other objects and advantages of this invention, along with features of novelty appurtenant thereto, will appear or become apparent in the course of the following detailed description.

BRIEF DESCRIPTION OF THE DRAWING

In the following drawings which form a part of the specification and which are to be construed in conjunction therewith, and in which like reference numerals have been employed throughout to indicate like parts in the various views.

DETAILED DESCRIPTION OF THE DRAWING

Figure 2:
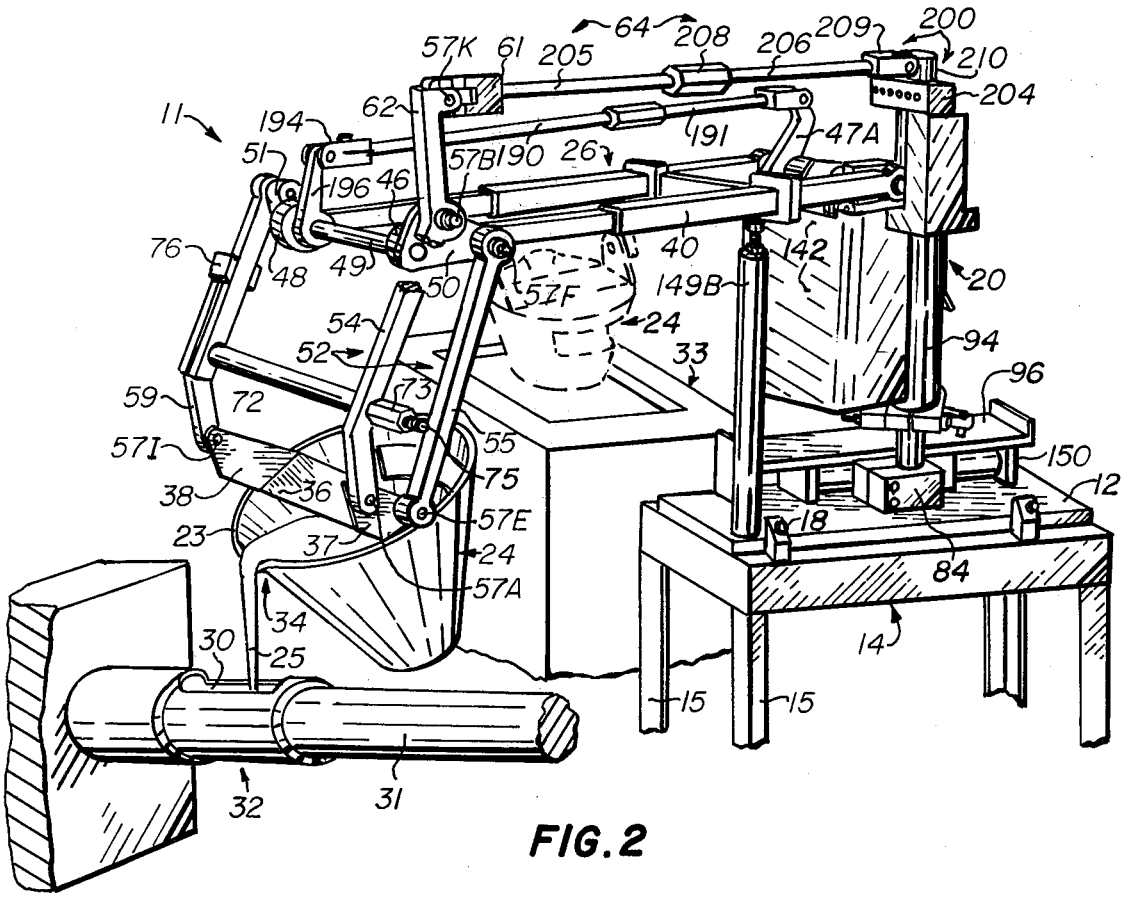
FIG. 2 is an isometric view similar to FIG. 1 showing the ladler in a pouring position, with parts thereof broken away for clarity.

With initial reference to FIGS. 1–4 of the drawings, thereshown is an automatic ladler system constructed in accordance with the teachings of this invention and generally designated by the reference numeral 11. Ladler 11 is adapted to be employed in conjunction with a control system which includes electrical control circuitry and associated hydraulic apparatus shown in detail in FIGS. 7–9. The ladler 11 functions to manually or automatically intake molten metal from a furnace and to pour it into the shot sleeve of a remotely located die casting machine, as best seen in FIG. 2.

In a preferred form the apparatus 11 comprises a rigid supporting base 12 which is adapted to be secured or otherwise attached to a stationary surface or structure such as a rigid mounting pedestal 14. Pedestal 14 may include legs 15 projections 16 provided with allen nuts 18 for rigidly securing base 12 in place. Alternatively, ladler 11 may be mounted on a shot cylinder tie rod or other stationary structure.

Rigid vertical stanchion structure 20 mounts a control platform 22 vertically above the lower base 12. The ladler bucket 24 is suspended from elevated platform 22 via support arm structure; generally designated by reference numeral 26. Platform 22 is adapted to be rotated with respect to base 12 to radially move the ladle bucket 24 between metal filling and metal pouring positions (FIG. 2). When tilted ladle bucket 24 will discharge molten metal 25 into a shot sleeve hole 30 provided in the die cast machine shot sleeve portion 32. It will be appreciated that after pouring, the empty ladle bucket 24 subsequently may be rotated towards metal bath 33 for filling. The die cast machine 32 is operable to fill a mold when plunger 31 is actuated.

The ladle bucket 24 is preferably in the form of an inverted, truncated cone comprising an upper rim 23 in which a front pouring spout 24 is formed by stamping or the like. A generally rectangular, narrow filling slot 35 is provided for admitting molten metal 25 into the bucket when it is immersed in the molten metal bath. Slot 35 is substantially parallel with rim 23. Mounting bracket 36 extends across the open top of bucket 24 and terminates in integral ends 37 and 38, which are turned upwardly to form pivot mounting brackets which are coupled through support linkage to the support arm means 26 as will now be described.

Figure 4:
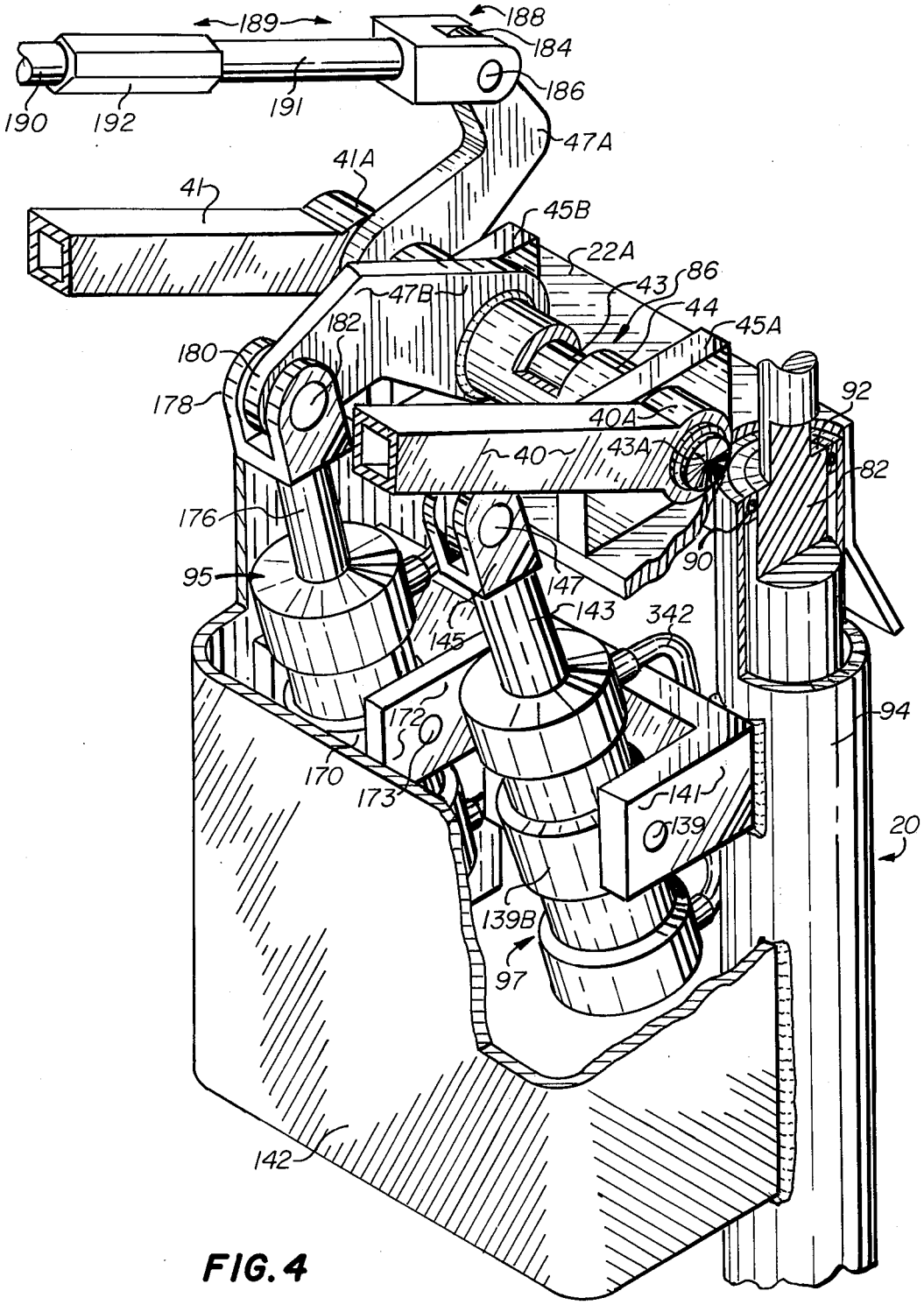
FIG. 4 is an enlarged isometric view of the hydraulic actuator cylinders and related hardware, with parts thereof broken away or shown in section for clarity.

Support arm means 26 preferably comprises a pair of generally parallel, spaced apart, elongated members 40, 41 which extend between the ladle bucket linkage and the platform 22. Arms 41 and 42 terminate at opposite ends of a transverse pivot pin 43, the ends of which are journaled for rotation. Within support arm bearing portions 41A, 40A (FIG. 4). Axial displacement of the support arms is prevented by a pair of snap rings on opposite ends of pin 43. Pin 43 is rotatably disposed within a sleeve 44, which couples first and second arcuate tilt links 47A, 47B. Sleeve 44 extends from a position adjacent vertical plate 45A and rotatably penetrates an adjacent parallel plate 45B. Both plates 45A, 45B are rigidly secured to platform surface 22A.

At their outer ends arms 40 and 41 respectively terminate in journaled bearing portions 46, 48, between and through which a generally transversely oriented tilt bar 49 extends. Bar 49 is rigidly secured at its opposite ends to spaced apart, revolvable first pivot brackets 50, 51. Parallelogram ladle link means 52 comprises a first elongated link 54 and a second generally parallel cooperating link 55 slightly shorter than link 54 which extend between pivot tilt brackets 37, 50. Link 54 is pivoted at 57A (at its bottom) to bracket 37 and is pivotally coupled at an intermediate portion of its length to bracket 50 via pivot point 57B. A similar link 59 is pivotally coupled between pivot brackets 38 and 51 at an opposite side of the support assembly. Linkage 54 includes an integral, upwardly extending extension portion 62 which is pivotally coupled to reach extension means 64 via a clevis assembly 61 forming a pivot 57K.

Second parallelogram link 55 is pivotally coupled at 57E, 57F to brackets 37, 50 respectively. Links 54, 55, 59 cooperate to tilt bucket 24 in response to rotation of brackets 50, 51. The reach and tilt systems will be discussed in detail hereinafter. However, it will be apparent that generally parallel links 54, 55 for a linkage system shaped generally in the form of a parallelogram. Each of the various pivot couplings 57A–57K interconnecting the various linkages preferably comprise oversized, nitrided heat treated steel sleeve bearings provided with extra clearance between the bearing and race portions to insure high temperature dependability.

To facilitate routine maintenance ladle 24 is releasably coupled to the linkage. Cross brace 72 is comprised of an outer sleeve welded to 54 and the upper portion of 59 support arms, and an inner rod 75 which slides through these support arms. Inner rod 75 is welded to removable bracket 76, the other end being threaded. Nut 73, when rotated in one direction will firmly attach removable bracket 76 to support arm 59. When rotated in the opposite direction (unscrewed), it will rotate against a stop, being a sleeve covering a short portion of the threaded end of inner rod 75. This allows a limited axial travel of inner rod 75. By loosening nut 73, removable bracket 76 may be slid away from pivot 57I, allowing release and removal of ladle.

Figure 6:
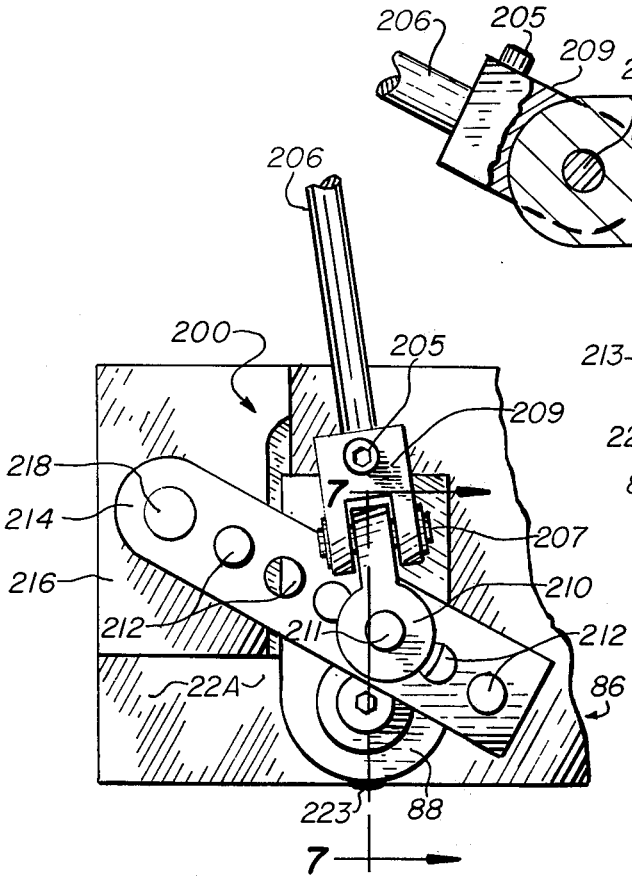
FIG. 6 is an enlarged isometric view of the reach extension cam system, with parts thereof broken away for clarity.
Figure 7:
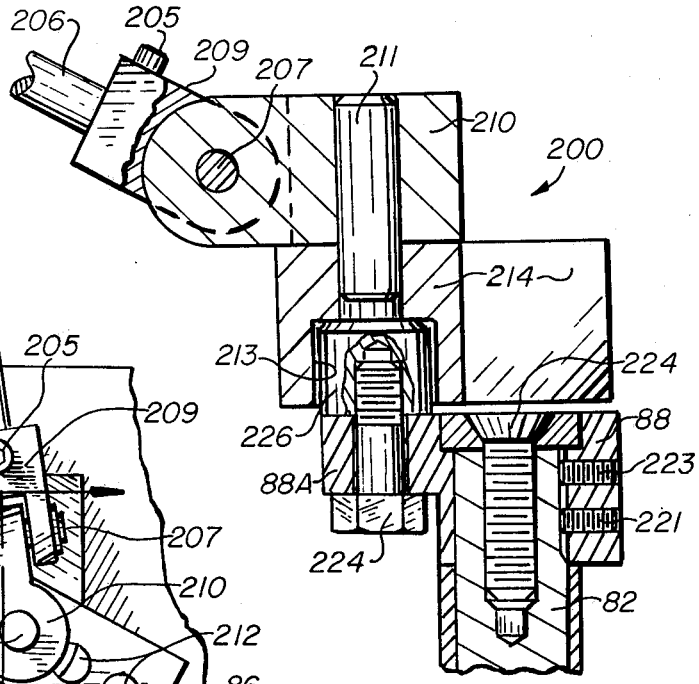
FIG. 7 is a sectional view of the reach extension cam system taken generally along 7—7 in FIG. 6.

The stanchion means 20 comprises a stationary, centrally disposed support rod 82 which is perpendicularly secured to plate 12 by a rigid mounting block 84. The uppermost portion of rod 82 extends through platform base 86 and supports a cam follower 88 (FIGS. 6, 7). As best viewed in FIG. 4, platform base 86 is coupled to rotatable sleeve 90, which coaxially surrounds rod 82. Sleeve 90 and rod 82 are separated by a bearing which facilitates relative rotation with similar lower bearing structure (not shown).

A drive collar 100 (FIG. 3) is secured firmly about stanchion sleeve 94 by compression of neck portion 105 thereof via tightening of nut 102 against threaded shaft 106. A generally rectangular spacer 108 is secured between but 103 and neck 111, and is pivotally coupled by pin 112 to a lower pivotal link 120. Link 120 is secured to an elongated linkage rod 122 by a bolt 123 threadably secured to threaded shank 124. Link 122 is in turn pivotally coupled through an allen nut fitting 130 to a rotary actuator arm 132, in turn secured to a rotatable shaft 134. It will be apparent that neck portion 136 of the rotary actuator arm 132 is secured about shaft 134 by tightening the nut and bolt assembly 137. Shaft 137 extends downwardly through a splash guard 96 into a rotary actuator 140 (FIG. 10) driven by hydraulic cylinder 144. The rotary actuator apparatus is preferably housed beneath splash guard 96 between end blocks 150, 152 attached to base 12. It will thus be apparent that actuation of hydraulic cylinder 144 will in turn cause rotation of shank 137, moving the rotary actuator arm 132 radially 180° in a direction as indicated in dotted lines in FIG. 3 (the dotted line view being 90° from the original position). Thus the stanchion sleeve will rotate platform 22 radially about the base to shift the ladle bucket 24 between metal filling and metal discharge positions illustrated in FIG. 2. It will be apparent to those skilled in the art that either clockwise or counterclockwise operation from the fill position to the pour position may be accomplished with minor adjustments to the structure disclosed.

To vary the radially displacement range of the platform it will be apparent that the position of collar 100 may be adjusted radially with respect to stanchion sleeve 94. To this effect it will be observed that nut 102 for example, may be loosened as desired to facilitate relative rotation between sleeve 94 and collar 100. Rotation of the platform will decrease as the pivot point is adjusted away from the illustrated center of rotation. In this manner the platform can be made to rotate between ninety and one hundred and fifty degrees to fit individual installation requirements. Once the desired radial displacement is known, the collar 100 need merely be retightened.

Since rotary actuator arm 132 always rotates through an arc of 180° and the rotating platform 22 always rotates through an arc of considerably less than 180°, by properly adjusting the length of link 122 there will be a gradual acceleration and de-acceleration of platform 22 at the end of its rotational travel. This prevents sloshing of metal from the ladle during rotation.

As best viewed in FIG. 4, raising and lowering of the ladle 24 is accomplished by actuation of the raise cylinder 97. Cylinder 97 is disposed generally within a shroud 142, being pivotally secured to a mounting bracket 141 via a pin 139 received by collar 139B on one side, and to mounting bracket 172 via a pin 173 on the other side. The piston includes rod 143 coupled via clevis assembly 145 and pin 147 to support arm 40. Arms 40 and 41 are linked by rigid cross brace 44 and bar 49 to operate in unison. It will be apparent that actuation of the main lift cylinder 97 will deflect the support arm members 40, 41 upwardly or downwardly to effectuate vertical ladle displacement as desired. The downward displacement is limited by vertical stop bar 149B (FIG. 1), which includes an adjustable threaded contact 149E adapted to be positioned to effectuate proper support arm pouring height.

Figure 5:
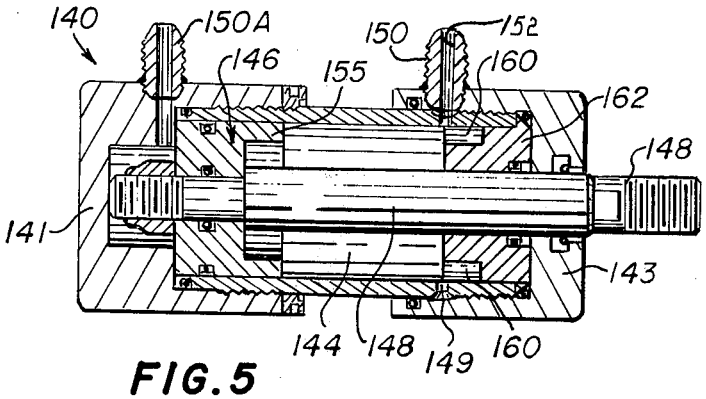
FIG. 5 is an enlarged sectional view illustrating preferred hydraulic cylinder internal construction.

In order to prevent sloshing or spilling of metal caused by sudden radical changes in vertical displacement, a cushioning effect, to be now described, has been provided within a preferred form of this invention. To this effect it will be noted that cylinder 97 (FIG. 5) comprises a generally cylindrical housing comprising threaded caps 141 and 143 threadably secured at opposite ends of threaded sleeve 148E. An internal cylinder volume 144 receives a slidable piston 146. One fluid input port will be observed, communicating interiorly of the cylinder through passageway 152 in fitting 150. A preferably tapered sleeve shaped extension 155 is formed about the periphery of piston 146 by counterboring or the like. A similar ring shaped volume 160 is defined in the stuffing box 162 about its outer edge. It will be observed that as the piston moves to the right (as viewed in FIG. 5) the extension 155 will be forced into engagement with the receptive volume 160 while moving past orifice 152. By variably occluding the orifice 152 extension 155 dampens the rate of hydraulic fluid flow to thereby provide a cushioning effect. It will be noted therefore that near the extreme end of piston travel the piston velocity will slowly decline, thereby slowly halting support arm movement. In this manner sloshing of molten metal within the ladle supported by the arms 40, 41 will be minimized. When the full ladle starts down, hydraulic pressure on the rod end of the piston is temporarily blocked by extension 155. The starting speed of the down travel is thus reduced until extension 155 gradually uncovers port 152. Port 152 is quite small, which reduces the pressure surge caused when it becomes unblocked. This allows a gradual increase in down travel of the full ladle, which prevents sloshing. Ladle tilting is accomplished by actuation of hydraulic cylinder 95, which is interconnected with a hydraulic supply network which will be described later in conjunction with FIG. 10. Cylinder 95 is preferably disposed within shroud 142 (FIG. 4) adjacent raise-lower cylinder 97. Collar portion 170 is pivotally coupled to frame member 172 by a pivot pin 173. Piston rod 176 terminates in clevis 178 which is pivotally coupled to a tongue end 180 of linkage 47B by a pin 182. It will be apparent that axial displacement of rod 176 thus rotates arcuate tilt link 47B, sleeve 44 and cooperating arcuate tilt link 47A, thereby axially moving tilt arm 189.

The tongue portion 184 of link 47A is pivotally coupled to clevis 188 by pin 186. The tilt arm means 189 includes a pair of elongated, generally cylindrical rods 190 and 191 which are coupled together by an internally threaded sleeve 192. Rod 191 is attached at its opposite end to clevis 188. The ends of rods 190, 191 disposed within sleeve 192 are oppositely threaded, so that the overall length of the tilt rod means may be adjusted by rotation of sleeve 192.

The opposite outermost end of tilt rod 190 extends to a clevis assembly 194, which is pivotally coupled to a tilt link 196 rigidly attached to tilt bar 49. It will be thus apparent that axial displacement of the tilt arm 189 results in rotation of tilt bar 49 and thus rotation of pivot brackets 50, 51 thereby tilting bucket 24 to a pouring position as illustrated in FIG. 2. Brackets 50 and 51 will rotate counterclockwise when cylinder rod 176 is retracted into piston 96. Rotation of 50 and 51 counterclockwise causes pivot 57F to raise in an arc around shaft 49. This in turn raises pivot 57E located on ladle bracket 36, causing the ladle to tilt. Rotation of 50 and 51 counterclockwise causes pivot 57B to also rotate through a small arc. Sinc pivot 57K is held stationary by rod 205–206, pivot 57A at the end of link 54 will describe a similar but larger arc. With appropriate lengths of 54–62, 55, and the positions of all pivots, the pouring spout 34 of the ladle can be made the center of this larger arc and the pouring spout will thus not move as the ladle is tilted. Since tilt rod 189 can be changed in length by rotation of sleeve 192, this rotation can be used to "fine tune" the tilt attitude of the ladle and thus change its holding capacity. Importantly, it should be noted that lower link 55 is shorter than link 54. As the reach of the ladle is decreased, the arc described by pivot 57A caused by a slight inward rotation of this link around pivot 57B will have a longer radius than that of pivot 57E on shorter link 55 when link 55 is rotated through the same arc. This results in a slight forward tilt of the ladle as it is retracted. In like manner, the ladle is tilted forward slightly by the upward travel of its supporting arms. This is accomplished by making tilt link 47A slightly longer than tilt link 196. The upward movement of the ladle supporting arms causes a slight forward rotation of link 196 due to its shorter length thus causing a slight counterclockwise rotation of tilt bar 49 which tilts the ladle forward slightly. These two actions combine to cause the filling slot in the rear of the ladle to be displaced slightly above the level of the molten metal in the ladle as it is raised and retracted. Sloshing from the filling slot is thus eliminated as the ladle moves from its filling position.

System 200 includes elongated reach rod means 64 which extends between linkage extension 62 and a cam means 204. The rod means 64 includes first and second elongated, generally cylindrical rod members 205, 206 having oppositely threaded ends which are received within an internally threaded sleeve 208. Rotation of sleeve 208 will vary the length of rod means 64 to vary of "fine tune" the amount of reach extension imparted to the ladle. The outermost end of rod portion 205 terminates in clevis assembly 61, thereby pivotally coupling the reach rod means 64 to the extension 62 of link 54. The innermost end of rod 206 terminates in a clevis 209 which is pivotally connected to a vertical coupling 210. Vertical coupling 210 includes a central pivot 211 which extends downwardly from the coupling and is adapted to be inserted in one of a plurality of holes 212 defined along the length of a cam 214. Cam 214 pivotally is coupled to platform wall 216 for rotation relative to platform 22 via a pin 218 which defines a cam pivot point. The cam is of generally elongated dimensions, being of generally C-shaped profile in section (FIG. 7). An elongated tracking slot 213 is thus defined in the undersided cam 214. Cam follower 88 is rigidly coupled to vertical support 82 through a pair of set screws 221, 223 and a cap screw 224. Bolt 224 extends upwardly through cam follower lip portion 88A and secures a projection 226 of cylindrical dimensions which tracks within tracking slot 213.

It will be apparent that rod 82 defines the center of rotation of the platform, whereas the spaced apart pivot 218 determines the center of rotation of the cam 214. It will thus be seen that radial movement of the platform generates axial displacement of the reach extension rod system 64 as the cam 214 is moved relative to the platform. By varying which coupling orifice or hole 212 receives pivot 211, the axial displacement of the reach arm experienced with a given degree degree of platform rotation can be adjusted for varying job applications.

Figure 1:
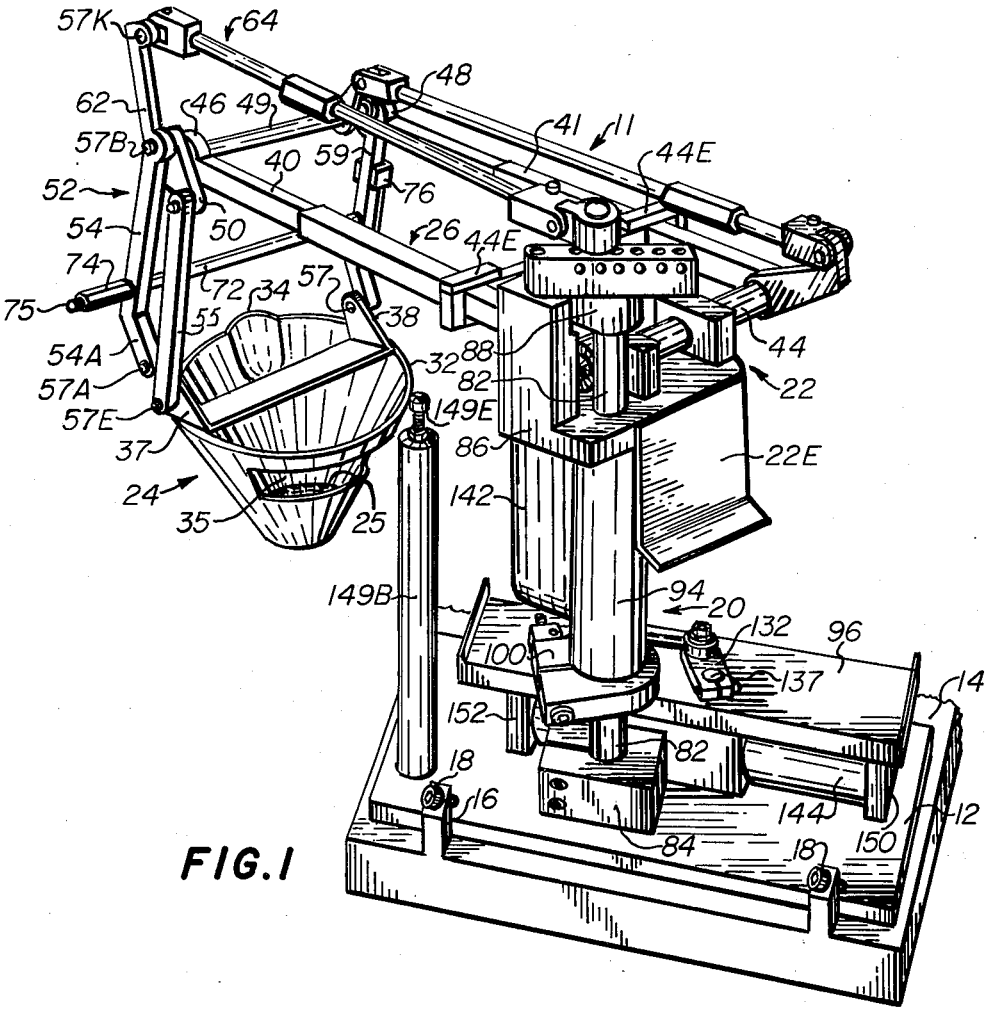
FIG. 1 is an isometric view of an automatic ladler constructed according to the teachings of this invention, with parts thereof cut away or shown in section for clarity.
Figure 10:
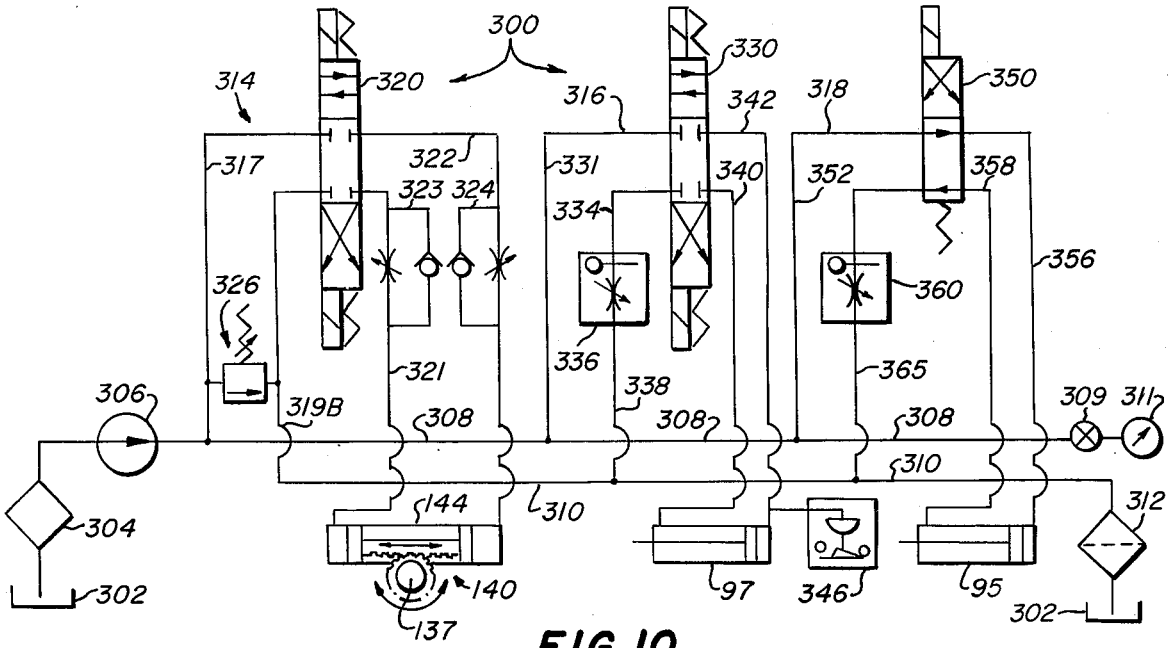
FIG. 10 is a hydraulic diagram illustrating the preferred hydraulic control system.
Figure 3:
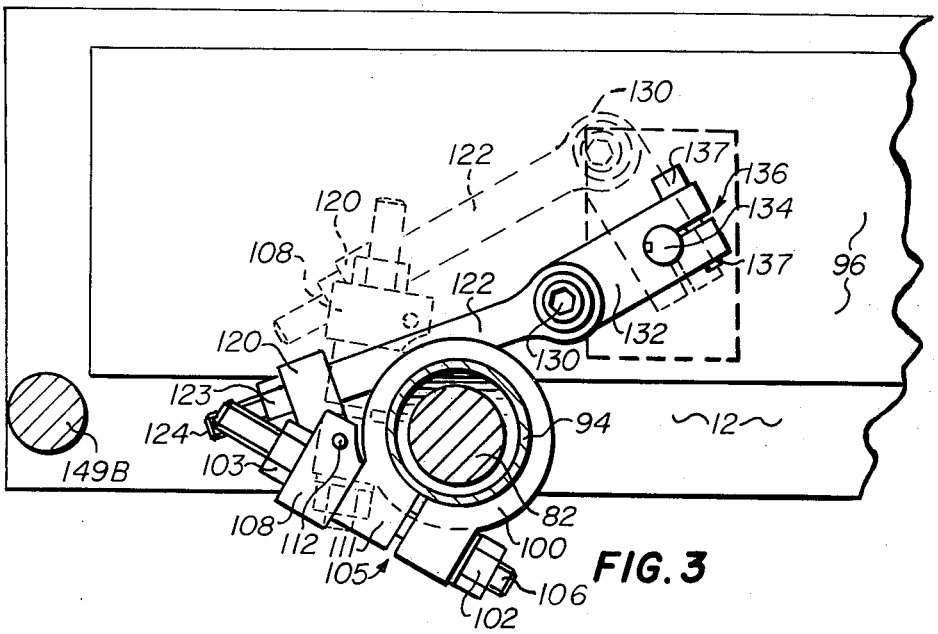
FIG. 3 is an enlarged top plan view of the rotary actuator linkage, with parts shown in section for clarity.

Turning now to FIG. 10, a preferred hydraulic system 300 for operating the present invention is depicted. Hydraulic fluid stored within a reservoir 302 is transferred through a preferably 200 mesh suction strainer 304 via a preferably ½ GPM hydraulic pump 306 which supplies hydraulic fluid under pressure to manifold 308. One pump suitable for this purpose is a model Double A Number PFG-05. Hydraulic fluid is returned from system 300 via a line 310 which terminates in a return line filter 312 outputting fluid to reservoir 302. A-10 micron filter is preferred, and a Vickers Model OFM-101-10 is satisfactory.

Fluid pressure within manifold 308 is controlled by a relief valve 326, and pressure is monitored by a pressure gauge 311 through a shut-off valve 309. Nominal operating pressure is 400 PSI. Proper hydraulic pressure within manifold 308 will subsequently control the three subsystems 314, 316, and 318. Subsystem 314 is employed to operate the rotary actuator 140 which ultimately produces rotation of the platform 22. Subsystem 316 controls the lifting of the support arm means to effectuate vertical displacement of the ladle. Finally, subsystem 318 operates the ladle tilt apparatus 189.

Subsystem 314 includes a double-solenoid spring centered control valve 320 which, when actuated by an electric circuit to be subsequently described, directs fluid to and from rotary actuator via either line 321 or 323 to rotate shaft 137 in a desired direction. Rotational speed is controlled by a pair of needle valve adjustments 323, 324 connected in lines 321, 323 respectively. If neither control solenoid is energized, valve 320 assumes a central position where all ports are blocked to freeze rotational motion of the ladle and platform. A pressure relief subplate 326 is interconnected between line 317 and hydraulic drain line 319. A suitable subplate is a Double A Model BNNNC-005-1081. Metering valves 323, 324 may comprise Double A model NNYYC-005-01A.

The "up-down" subsystem 316 includes another double solenoid spring centered control valve 330. This valve may also comprise a Double A Model QF-005-Z-10B1. Pressured fluid is imputted by a line 331 from manifold 308 and fluid is returned via line 334, temperature compensated flow control 336, and line 338 into return manifold 310. The temperature compensated flow control 336 may comprise a Rexroth Model F5T3-3231/122Q. The output of valve 330 may be applied to either lines 340 or 342 to raise or lower the ladle and support arms by accuating the raise lower cylinder 97. Importantly, a pressure sensitive switch 346 included to monitor pressure on line 342 during immersion of the ladle in molten metal during the filling operation to effectuate depth control.

When neither solenoid associated with valve 330 is energized, valve 330 will move to its centered position to free vertical motion of the ladle.

The lift speed and lower speed of the cylinder 97 is controlled by the single temperature compensated flow control 336 which meters the flow of all fluid.

The subsystem 318 is actuated to tilt the ladle by operating the tilt arm means 64 already described. A single solenoid offset control valve 350 receives pressured fluid from manifold 308 via a line 352. Ladle tilt hydraulic cylinder 95 is interconnected to valve 350 via fluid lines 356 and 358. Energization of the control solenoid causes the ladle to tilt whereas deenergizing the solenoid causes the ladle to return to its upright position. Tilting and uprighting speed is controlled by a single temperature compensated flow control valve 360, nominally a Rexroth Model F5P3-231/1.2Q. Fluid is returned from valve 360 via a line 365 into return manifold 310.

Figure 8:
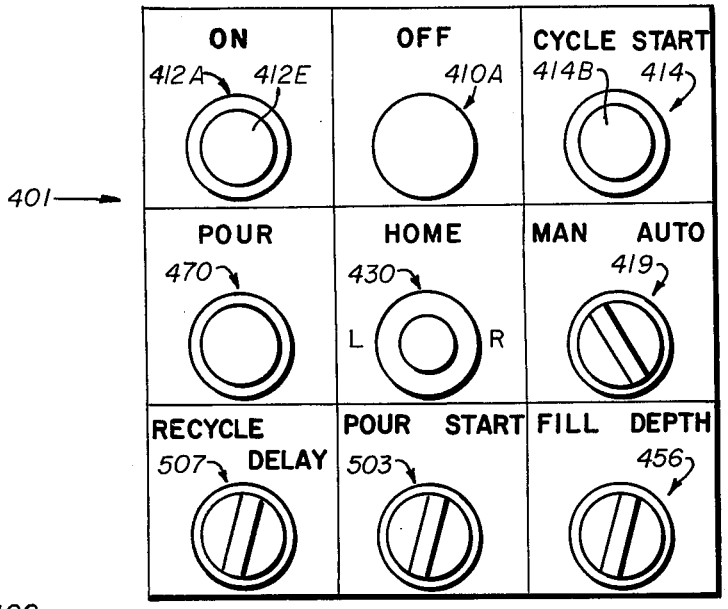
FIG. 8 is a front elevational view of a control panel preferably employed with the instant invention.
Figure 9:
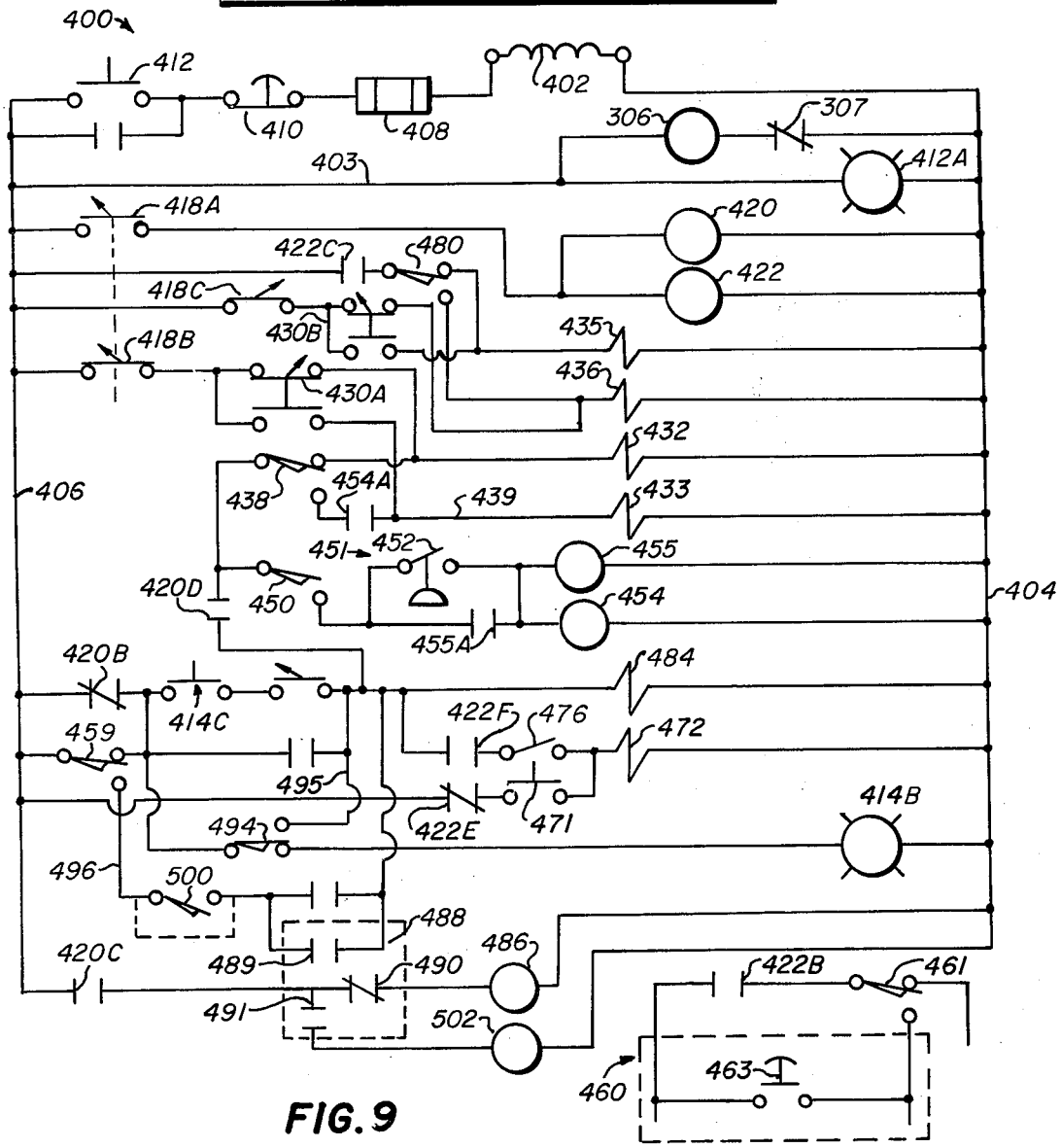
FIG. 9 is a schematic diagram of the electrical control circuitry preferably employed.

With reference now to FIGS. 8 and 9 electrical control of ladler 11 is effectuated through control panel 401 which houses a plurality of control knobs for operating switching circuits schematically shown in FIG. 9. Control circuit 400 is energized with nominally 120 volts alternating current by transformer 402 which supplies voltage across buss lines 404, 406 through a fuse 408, an emergency "off" switch 410, and an "on" switch 412. It will be appreciated that switches 410, 412, are respectively controlled by knobs 410A, 412A, in control panel 401. The "off" control disconnects voltage from all circuits to freeze regular motion and stop hydraulic pump 306. In the "auto" mode (except in emergencies) the "off" button should not be depressed until the operating cycle is completed and the "cycle start" warning light 414B is illuminated. Actuation of "on" switch 412 thus accuates hydraulic pump 306 via line 403 so that hydraulic pressure will be applied to system 300 (FIG. 10).

The "manual-automatic" selector 419 controls multisection switch 418A, 418B. Switch 418A actuates a pair of SPDT relay fields 420, 422. Field 420 actuates switching contacts 420B, 420C, 420D, and 420E when actuated by knob 419. Similarly, relay 422 pulls in contacts 422B, 422C, 422D, 422E, and 422F.

Ladle movement control is provided by "joy stick" switch 430, which may be manually moved between four positions to move the ladle. Thus the ladle control switch may be moved either up, down, or to the left or the right (as viewed in FIG. 8). Control 430 switches contact sets 430A and 430B. When switch 430 is moved to the "up" position the up solenoid field 432 will be actuated thereby switching hydraulic valve 330 (FIG. 10) and ultimately actuating piston 97 (FIG. 4). When the joy stick 430 is moved to a "down" position, contacts 430A will move to the lower position thus energizing down solenoid field 433 via line 439 to reverse valve 330. Similarly, with switch 419 in the manual position, switch contacts 418C are closed so that joy stick switch element 430B may be moved either to the left to energize swing solenoid field 435, or to the right to operate right swing solenoid field 436. Solenoids 435, 436 operate valve 320 (FIG. 10) to control rotary actuator 140.

When in the automatic mode vertical travel of the ladle is under control of the cam switch 438, which employs a motor driven cam to provide a raise lower sequence for each operating cycle. Timing sequences are fixed by the shape of the cams.

Just after the automatic cycle starts cam switch 438 switches down, lowering the ladle by actuating down solenoid field 433 via line 439. As the ladle lowers in the metal bath, cam switch 450 switches down energizing the ladle fill control circuit 451. As mentioned previously, as the ladle enter the molten metal it is buoyed up by metal that it displaces, resulting in a reduction in hydraulic pressure required to support it. This pressure reduction is sensed by monitor sensor 346 (FIG. 10). Sensor 346 controls pressure switch 452 which energizes a ladle fill depth timer 454 and a ladle fill depth relay 455. Timer relay 454 and depth relay 455 respectively control contacts 454A and 455A. It will be noted that when contacts 454A are closed, down solenoid field 433 will be actuated by a line 439. Thus, the down travel of the ladle into molten metal will be stopped when timer 454 opens contacts 454A. Adjustment of the fill depth control 454 is accomplished by adjustment of knob 456 (FIG. 8) on the control panel. Relay 455, when energized, latches timer relay 454 and itself in the energized state, allowing timer relay 454 to continue timing out regardless of subsequent movements of pressure switch 452.

The depth control is not affected by metal level variations, and the ladle will always penetrate the same distance into the metal bath with a given fill depth control setting. When filling is complete, the ladle raises from the metal bath. At this time cam switch 450 switches up disconnecting field 455 and resetting timer 454. Pressure in the raise circuit. Since operation of the automatic up-down apparatus is dependent upon switch elements 420D being closed, the ladle cams move up and down in the automatic modes only when the cam switch drive motor is energized and running. After cam switch 438 switches down a second time causing the ladle to lower into a ready to pour position, cam switch 459 will switch down, energizing the pour safety circuit.

Shot control circuit 460 includes relay contacts 422B and a cam driven switch 461. Shot switch 463 is part of the die casting machine, which is wired into circuit 400 shown. In the manual mode the circuit is always open due to the normally open contacts of switch 422B. In the automatic mode contacts 422B are closed by relay 422 allowing the cam switch 461 to initiate the shot. It will be apparent that closure of switch 461 will effectively bypass the standard diecast shot machine control switch 463 to allow automatic initiation of the shot.

Pouring is effectuated by accuating tilt cylinder 95. In the manual mode pressing of "pour" buttom 470 will close switch contacts 471 thereby energizing solenoid 472. Solenoid 472 will actuate control valve 350, as discussed in conjunction with FIG. 7. In the automatic mode cam switch 476 switches down, causing the ladle to start tilting. As soon as the ladle empties, switch 476 switches up causing the ladle to return to its upright position. The cam switch is preferably switched on only after the ladle starts rising toward the home position whereby facilitating clearance above the shot sleeve structure. In order to reduce sloshing of metal, cam switch 476 is set to cause ladle to tilt slightly as it lowers to the ready to pour position. As soon as it arrives in the ready to pour position, ladle returns to its upright position by the downward switch action of cam switch 459, which de-energizes circuit 495.

In the manual mode rotational movements of the ladle follow the horizontal movements of the joy stick control 430. Thus movement of the stick to the left (viewed in FIG. 8) will energize swing left relay 435, and movement to the right will energize swing right relay field 436. Both field solenoids 435, 436 control the valve 320 which causes control cylinder 144 to effect rotary movement. In the automatic mode rotational movements of the platform are controlled by cam switch 480. After the automatic cycle starts the cam switch 480 causes the ladle to rotate towards the metal bath. After the fill cycle is completed cam switch 480 pulls down causing the ladle to rotate toward the shot sleeve for the pouring cycle.

All of the aforementioned cam switches are controlled by cam switch drive motor 484 which may be started by cycle start button 414 (which controls switch 414C) timer 486. Cycle control may also be initiated by recycle delay timer 486 which starts timing as soon as the die cast machine starts to open, responsive to switch 490. The electrical circuit 400 should be connected to the wiring 488 of the die cast machine as illustrated. Switch contact 489, 490, 491 are part of the die cast machine and are controlled thereby. Contacts 491 will close when the die cast machine starts forward.

Immediately after cam switch drive motor 484 starts cam switch 494 will switch up to contact line 495, latching the circuit and allowing drive motor 484 to continue running after either the "cycle start" button 414 is released or relay 486 is reset by the die cast machine. As soon as a full ladle approaches a "ready to pour" position, cam switch 459 applies power to line 496 and cam switch drive motor 484 will continue running only if the ladle pour safety circuit is complete. The safety circuit comprises an optional, external limit switch 500 which must be closed before pouring can occur. (Second pour start delay timer 502 must be timed out or the die must be locked up). With timer 502 installed early pouring before die lock up may be initiated through timer 502 contacts 505 by adjusting pour start control 503. (FIG. 8) which controls pour start delay timer 502. After pouring is completed and the ladle is raised to its home position, cam switch 494 switches to its lower position stopping the cam switch drive motor 484 and turning on the "cycle complete" indicator light 414B located in the cycle start button.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the drawings to be interpreted as illustrative and not in a limiting sense.

Having thus described my invention, I claim:

1. An automatic ladler device comprising:

a supportive base adapted to be disposed upon a supporting plane;

ladle means for containing molten metal;

platform means for radially moving said ladle means between metal filling and metal discharge position;

elongated ladle support arms means pivotally coupled to said platform means for controllably suspending said ladle means from said platform means;

linkage means for pivotally coupling said ladle means to said ladle support arm means;

rigid, rotatable stanchion means extending vertically upwardly from said base for operatively mounting said platform means above said base;

means for raising and lowering said ladle support arm means whereby to raise and lower said ladle means;

means for rotating said stanchion means whereby to move said platform means and said ladle means radially between metal filling and metal discharge positions; and means for discharging molten metal from said ladle means.

2. The combination as defined in claim 1 including reach extension means for extending said ladle means outwardly away from said platform means in response to rotation of said platform means.

3. The combination as defined in claim 2 wherein said reach extension means comprises:

cam means positioned to be revolved about a center of rotation by said platform means;

reach rod means coupled to said linkage means; and means for pivotally coupling said reach rod means to said cam means.

4. The combination as defined in claim 3 wherein said cam means is pivotally coupled at one end to said platform means and is provided with a plurality of orifices for coupling to said reach rod means, said orifices being located at varying distances with respect to the center of rotation of said cam means whereby to facilitate adjustments in the amount of reach extension imparted to said ladle means.

5. The combination as defined in claim 1 wherein said means for discharging molten metal from said ladle means comprises:

elongated tilt arm means coupled to said linkage means and extending to said platform means; and means for moving said tilt arm means axially to effectuate tilting of said ladle means.

6. The combination as defined in claim 5 including:

tilt bar means perpendicularly coupled to said ladle support arm means and journaled for rotation with respect thereto;

means for coupling said tilt arm means to said tilt bar means to rotate said tilt bar means;

first pivot bracket means rigidly coupled to said tilt bar means for rotation thereby;

second pivot bracket means attached to said ladle means; and said linkage means including first and second parallelogram members extending between and pivotally coupled to each of said first and second pivot bracket means.

7. The combination as defined in claim 6 including reach extension means for extending said ladle means outwardly away from said platform means in response to movement of said platform means to said metal filling position.

8. The combination as defined in claim 7 wherein said first parallelogram member includes an integral extension portion and said reach extension means comprises:

cam means positioned to be revolved about a center of rotation by said platform means;

reach rod means pivotally coupled to said extension portion of said first parallelogram member; and means for pivotally coupling said reach rod means to said cam means.

9. The combination as defined in claim 8 wherein said cam means is pivotally coupled at one end to said platform means and is provided with a plurality of orifices for coupling to said reach rod means, said orifices being located at varying distances with respect to the center of rotation of said cam whereby to facilitate course adjustments in the amount of reach extension imparted to said ladle means.

10. The combination as defined in claim 1 wherein said means for raising and lowering said ladle support arm means cushioned by hydraulic cylinder means, said hydraulic cylinder means including:

an interior cylinder in fluid flow communication with at least one hydraulic fluid port;

a piston slidably disposed within said interior cylinder; and a piston extension projecting from said piston for partially blocking said fluid port when said piston nears a limit of its travel whereby to cushion said hydraulic cylinder means.

11. The combination as defined in claim 1 wherein said ladle means includes a top rim and an elongated, horizontally oriented fill slot defined therein beneath said rim for filling of said ladle means.

12. An automatic ladler machine comprising:

a frame adapted to be secured to a stationary structure;

ladle means for containing molten metal;

support arm means pivotally coupled to said frame for operably suspending said ladle means from said frame;

hydraulic cylinder means for raising and lowering said support arm means and said ladle means; and ladle fill depth control means for controlling ladle means loading, said depth control means comprising:

hydraulic pressure sensing means adapted to be triggered in response to a predetermined reduction in hydraulic pressure in said hydraulic cylinder means; and timer means responsive to said hydraulic pressure sensing means for facilitating immersion of said ladle means in molten metal for a preselected time after actuation of said hydraulic pressure sensing means whereby to control filling of said ladle means.

13. The machine as defined in claim 12 including:

platform means coupled to said support arm means for radially moving said ladle means between metal filling and metal discharging positions;

stanchion means extending vertically upwardly from said frame for elevating said platform means above said frame;

linkage means for pivotally attaching said ladle means to said support arm means; and means for rotating said stanchion means.

14. The combination as defined in claim 13 including reach extension means for extending said ladle means outwardly away from said platform means in response to rotation of said platform means to said metal filling position.

15. The combination as defined in claim 14 wherein said reach extension means comprises:

cam means positioned to be revolved about a center of rotation by said platform means;

reach rod means coupled to said linkage means; and means for pivotally coupling said reach rod means to said cam means.

16. The combination as defined in claim 15 wherein said cam means is pivotally coupled at one end to said platform means and is provided with a plurality of orifices for coupling to said reach rod means, said orifices being located at varying distances with respect to the center of rotation of said cam means whereby to facilitate course adjustments in the amount of reach extension imparted to said ladle means.

17. The combination as defined in claim 13 including:

tilt bar means generally transversely coupled to said support arm means and journaled for rotation with respect thereto;

elongated tilt arm means pivotally coupled between said tilt bar means and said platform means;

first pivot bracket means rigidly coupled to said tilt bar means for rotation thereby;

second pivot bracket means rigidly coupled to said tilt bar means for rotation thereby;

second pivot bracket means rigidly attached to said ladle means;

said linkage means including first and second parallelogram members extending between and pivotally coupled to each of said first and second pivot bracket means; and means for axially moving said tilt arm means to thereby tilt said ladle means.

18. The combination as defined in claim 12 wherein said hydraulic cylinder means includes an internal piston, at least one fluid input port, and extension means projecting from said piston for partially blocking said fluid input port when said piston nears a limit of its travel whereby to cushion said hydraulic cylinder means.

19. A ladler system comprising:

ladle means for containing and transferring molten metal, said ladle means having a pouring point;

elongated support arm means for raising and lowering said ladle means; and linkage means for coupling said ladle means to said support arm means, said linkage means including:

first pivot bracket means rotatably coupled to said support arm means;

second pivot bracket means rigidly attached to said ladle means;

first parallelogram linkage means pivotally coupled to and extending between said first and second pivot bracket means; said first parallelogram linkage means including an integral, upwardly extending portion; and second parallelogram linkage means pivotally coupled to and extending between said first and second pivot bracket means; and reach rod means coupled to said upwardly extending portion of said first parallelogram linkage means to move said ladle means inwardly or outwardly with respect to said system when said ladle means is respectively raised or lowered whereby to substantially maintain the horizontal position of said pouring point during raising and lowering of said ladle means.

20. The system as defined in claim 19 including:

transverse tilt bar means rotatably received by said support arm means, said first pivot bracket means rigidly coupled to said transverse tilt bar means;

tilt arm means pivotally coupled to said tilt bar means; and means for axially moving said tilt arm means for tilting said ladle means.

21. The system as defined in claim 19 including rotatably platform means for radially moving said ladle between filling and discharging positions.

22. The system as defined in claim 21 including cam means having a center of rotation and responsive to rotation of said platform means for axially moving said reach rod means to move said ladle means outwardly with respect to said system when radially moving toward said filling position.

23. The system as defined in claim 22 wherein said cam means includes a plurality of spaced apart orifices for receiving said reach rod means, said orifices located at varying distances with respect to the center of rotation of said means whereby to facilitate adjustments in the amount of reach extension imparted to said ladle means.

* * * * *